US005596598A

United States Patent [19]

Delahalle et al.

[11] Patent Number: 5,596,598

[45] Date of Patent: Jan. 21, 1997

[54] ELECTRIC MELTING DEVICE

[75] Inventors: Gerard Delahalle, Conflans Sainte-Honorine; Stephane Maugendre, St.-Leu D'Esserent; Thierry Caillaud, Margny-les-Compiegnes; Pierre Peigne, Franconville; Francois Szalata, Rantigny, all of France

[73] Assignee: Isover Saint Gobain, Courbevoie, France

[21] Appl. No.: 424,526

[22] PCT Filed: Sep. 27, 1994

[86] PCT No.: PCT/FR94/01124

§ 371 Date: Jul. 26, 1995

§ 102(e) Date: Jul. 26, 1995

[87] PCT Pub. No.: WO95/09518

PCT Pub. Date: Apr. 6, 1995

[30] Foreign Application Priority Data

Sep. 30, 1993 [FR] France ..... 93 11679

[51] Int. Cl.[6] ..... H05B 7/06

[52] U.S. Cl. ..... 373/93; 373/37; 373/52; 373/94

[58] Field of Search ..... 373/94, 50, 52, 373/37, 93, 105, 36, 38

[56] References Cited

U.S. PATENT DOCUMENTS

| | | | |
|---|---|---|---|
| 2,599,179 | 6/1952 | Hopkins | 373/36 |
| 3,327,040 | 6/1967 | Molstedt et al. | 373/36 |
| 4,477,911 | 10/1984 | Racki | 373/36 |
| 4,610,015 | 9/1986 | Hill et al. | 373/93 |
| 4,710,607 | 12/1987 | Wilhelmi et al. | 219/121.36 |
| 4,965,812 | 10/1990 | Sorg et al. | 373/36 |

FOREIGN PATENT DOCUMENTS

| | | | |
|---|---|---|---|
| 0135473 | 3/1985 | European Pat. Off. | 373/36 |
| 0372111 | 6/1990 | European Pat. Off. | 373/36 |

*Primary Examiner*—Tu Hoang

*Attorney, Agent, or Firm*—Oblon, Spivak, McClelland, Maier & Neustadt, P.C.

[57] ABSTRACT

A support for a melting electrode used in a glass melting bath. The support includes concentric tubes which provide for the circulation of a cooling fluid within the support. A current is provided through the outer tube to the electrode. The surface of the outer tube is electrically insulated and may be protected by a second cooling system outside the electrical insulation.

11 Claims, 2 Drawing Sheets

ELECTRIC MELTING DEVICE

BACKGROUND OF THE INVENTION

1. Field of the Invention

The invention relates to electric melting techniques, and more specifically those in which energy is dissipated in the molten mass by Joule effect, by means of plunging electrodes.

2. Discussion of the Background

For a long time, glass production installations which operate on large quantities have been provided with melting furnaces which are supplied with fossil fuel, such as fuel oil or gas. This is the case in particular for large capacity continuous production installations which for example provide flat glass or bottle glass. When electrical energy is in these large furnaces, it is essentially as a local booster, in order to maintain the temperature of the glass in the least hot areas, or outside the furnace along the path of the glass towards its place of transformation, or in order to develop specific convection movements, to assist homogenization, refining or transport of the molten material.

True electric melting was used firstly in small units in which considerable flexibility in the conditions of use appeared to be necessary. Fluctuations of energy costs and gradual mastery of certain technological problems have led more recently to the development of major production units in which all of the melting process, with the exception of commissioning, takes place using electric energy. This development requires the solution of extremely delicate technological problems.

Thus, in particular, in order to avoid oxidation of the electrodes at the surface of the melting bath, it has been proposed to immerse the electrodes completely. This is the solution used for example in French patent application FR-A-2 552 073. In this document, the electrodes are disposed vertically in the bath, such that they project from the hearth of the furnace. In other embodiments, electrodes also pass through the lateral walls of the furnace.

Irrespective of the advantages it provides relative to corrosion problems, immersion of the electrodes also permits convenient, regular supply of the surface of the bath with a composition of raw-materials. Formation of a relatively thick layer of composition to be melted, floating on the molten bath, is in fact advantageous for several reasons. In contact with the melting bath, it provides the permanent reserve of material necessary for continuous operation. It also protects the melting bath against substantial loss of heat by convection in contact with the atmosphere, and in particular by radiation.

Although furnaces of the type described in the aforementioned document have very important industrial applications, they do not necessarily provide the best solution to all requirements encountered in practice. For example, in some cases, and with the obvious purpose of limiting investment costs, it is desirable to transform installations which operate with burners by maintaining as many as possible of the existing components, and in particular the refractory materials which constitute the pouring basin. Transformation of this type is not possible when the electrodes are to be installed in the hearth or in the lateral walls of the furnace.

Furnaces of which the electrodes are immersed, have limited possibilities for adjusting the electrodes. Although they provide entirely satisfactory performance for specific operating conditions, they are less suitable for frequent and/or substantial modifications of these operating conditions.

In addition, even though the technology of immersed electrodes has now been well-mastered, and a long service life of the electrodes which is comparable with that of the refractory units can be envisaged, the risk of premature deterioration of one of a plurality of electrodes, thus affecting satisfactory operation, cannot be altogether eliminated.

Another solution which is described in particular in French patent application 2 599 734, consists of plunging electrodes through the free surface of the bath of molten material. This technique has a given number of advantages. Firstly, it obviously prevents the difficulties associated with the passage of these electrodes through the refractory unit, and also problems of replacement of worn electrodes, sealing or wear of the refractory units, in particular owing to a high temperature which assists attack of the refractory units, and powerful convection currents which develop in contact with the latter.

The technique of plunging electrodes localises the hottest areas in the upper part of the molten bath, and thus attenuates these problems.

In addition, this technique permits modification of the depth of immersion of the electrodes, and thus the temperature gradient. This allows the draught of the furnace to be modified without changing the temperature of the hearth, and thus the temperature of the glass at the furnace outlet.

Additionally, experience has shown that this technique has a very satisfactory thermal output, and provides good quality of the molten material.

Plunging electrodes are conventionally attached to supports which overhang the melting basin from the sides of the latter. Application FR-A-2 599 734 describes a support of this type which consists of an arm which comprises ducts for circulation of the cooling fluid, and an electric cable for supplying the electrode and the electrode support.

In normal operation, a layer of composition deposited on the surface of the melting bath, which constitutes protection against thermal losses, prevents the temperature of the arms which overhang the melting bath from becoming too high.

On the other hand during a waiting period, in which the layer which protects the raw materials is either very thin or lacking, the temperature of the arm becomes very high, and gives rise to deterioration of the electric supply system.

In order to eliminate this disadvantage, a conventional solution consists of raising the plunging electrodes during a waiting period, and maintaining a sufficient temperature in the bath by means of immersed electrodes, which are usually disposed on the walls. This technique is effective, but there are again problems associated with the immersed electrodes, although in the present case they operate at lower voltages, since they are only maintaining the temperature of the already molten bath. Moreover, immersed electrodes of this type require additional investment costs.

Another solution proposed, which is described in particular in U.S. Pat. No. 4,965,812, consists of using an electrode support which consists substantially of a current conductor water-Jacket type cooling system. The supply system is then cooled continually, and thus protected against the temperature increase which occurs during a waiting period. On the other hand this type of installation requires a protection device, since the power to the electrode support is maintained permanently switched on.

A device of this type usually consists of a grid which prevents the operators from gaining access to the furnace.

However specific steps which require the presence of an operator in the vicinity of the bath, and thus of the electrode supports, put the operator in danger.

SUMMARY OF THE INVENTION

The object of the invention is a device for electric melting of a vitrifiable load, which functions both in normal operating conditions and in the periods of wait, without the intervention of immersed electrodes and without any risk to the operators.

This object is achieved according to the invention by means of a support for a melting electrode which is immersed from the surface of a melting bath, the said support comprising a power lead system, and having on its surface thermal protection, the said surface being insulated relative to the current conductor voltage.

An electrode support of this type eliminates the problems posed by the prior art. In fact there is no longer any risk for the operators, associated with maintaining the electrode supply voltage. Additionally, when the melting furnace is in a waiting period, the temperature increase caused in particular by radiation from the bath of molten glass does not give rise to deterioration of the support, since the latter has a surface which is thermally insulated.

According to a preferred embodiment of the invention, the power lead system is a cooling system of the electric current conductor water-jacket type. This device is then surrounded by electric insulation, which is advantageously made of a material resistant to very high temperatures.

The insulation which is selected to resist high temperatures is advantageously cooled by circulation of water from the current conductor cooling system.

During a waiting period, since the temperature of the support becomes very high owing to radiation, an insulating material which is resistant to these temperatures, and a priori is very expensive, must be selected.

The invention advantageously proposes surrounding the electric insulation by a second, water-jacket type cooling system. A material for the electric insulation which is resistant to lower temperatures can thus be selected. Additionally, the electric insulation properties of a material of this type generally improve at low temperatures.

In addition, cooling of this electric insulating material ensures that it is long-lasting.

The electrode support thus proposed therefore comprises two cooling systems. The cooling systems advantageously consist of water circulation. Since the inner system is the electric current conductor for the electrode supply, according to the invention there are two separate water circulation circuits, such that the water which conducts the current and circulates in the cooling system which supplies the electrode, does not supply voltage to the second cooling system, which would consequently no longer be of use.

According to another preferred embodiment of the invention, the two cooling systems are supplied by a single water circuit, the water being demineralized such that it does not conduct current. The water supply device outside the electrode support can thus be limited to a single circuit.

BRIEF DESCRIPTION OF THE DRAWINGS

Other advantageous details and features of the invention will become apparent from the embodiment described with reference FIGS. 1, 2 and 3, in which.

DESCRIPTION OF THE PREFERRED EMBODIMENTS

Figure 1:
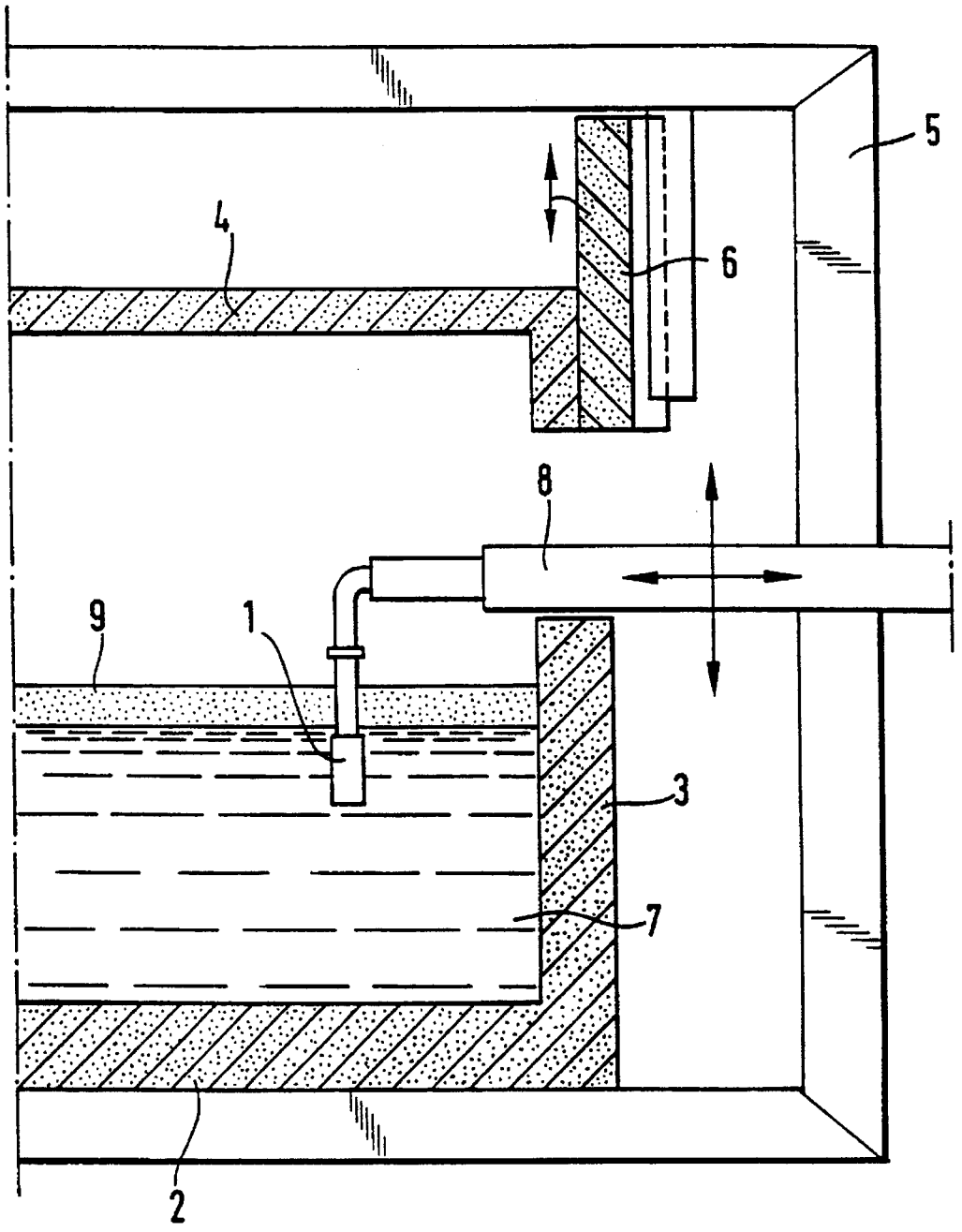
FIG. 1 is a schematic partial cross-section of a furnace comprising electrodes immersed vertically from the surface.

The drawing in FIG. 1 represents part of a melting furnace associated with plunging electrodes 1. The furnace consists of a refractory basin comprising the hearth 2 and lateral walls 3. Above the basin, the refractory vault 4 is suspended from a metal frame 5 which is partially represented, the said metal frame 5 straddling the furnace.

Mobile refractory walls 6 are provided, which, when they are in the low position, i.e. supported on the lateral walls 3, enable the melting bath 7 to be isolated partially from the surrounding atmosphere.

Apertures in the wall 6 are provided only for passage of the electrode supports 8.

This low position of the wall 6 is adopted when the furnace is in a waiting period, and no longer needs to be supplied with raw materials. This enables an excessive loss of heat to be avoided, and the risk of damaging all the surrounding equipment.

The electrode 1 is immersed in the surface of the melting bath 7, beneath the layer 9 of raw materials to be melted. This layer 9 which covers the melting bath 7 in normal operation, insulates the basin thermally, and prevents heat losses.

The electrode 1 is attached to the support 8, which comprises the electric supply system and a device for cooling the electrode 1, which are not shown in FIG. 1.

The support 8 is in turn connected to a mechanism not shown, which enables an electrode 1 to be removed from the bath, for example in order to be changed or repaired.

Figures 2, 3:
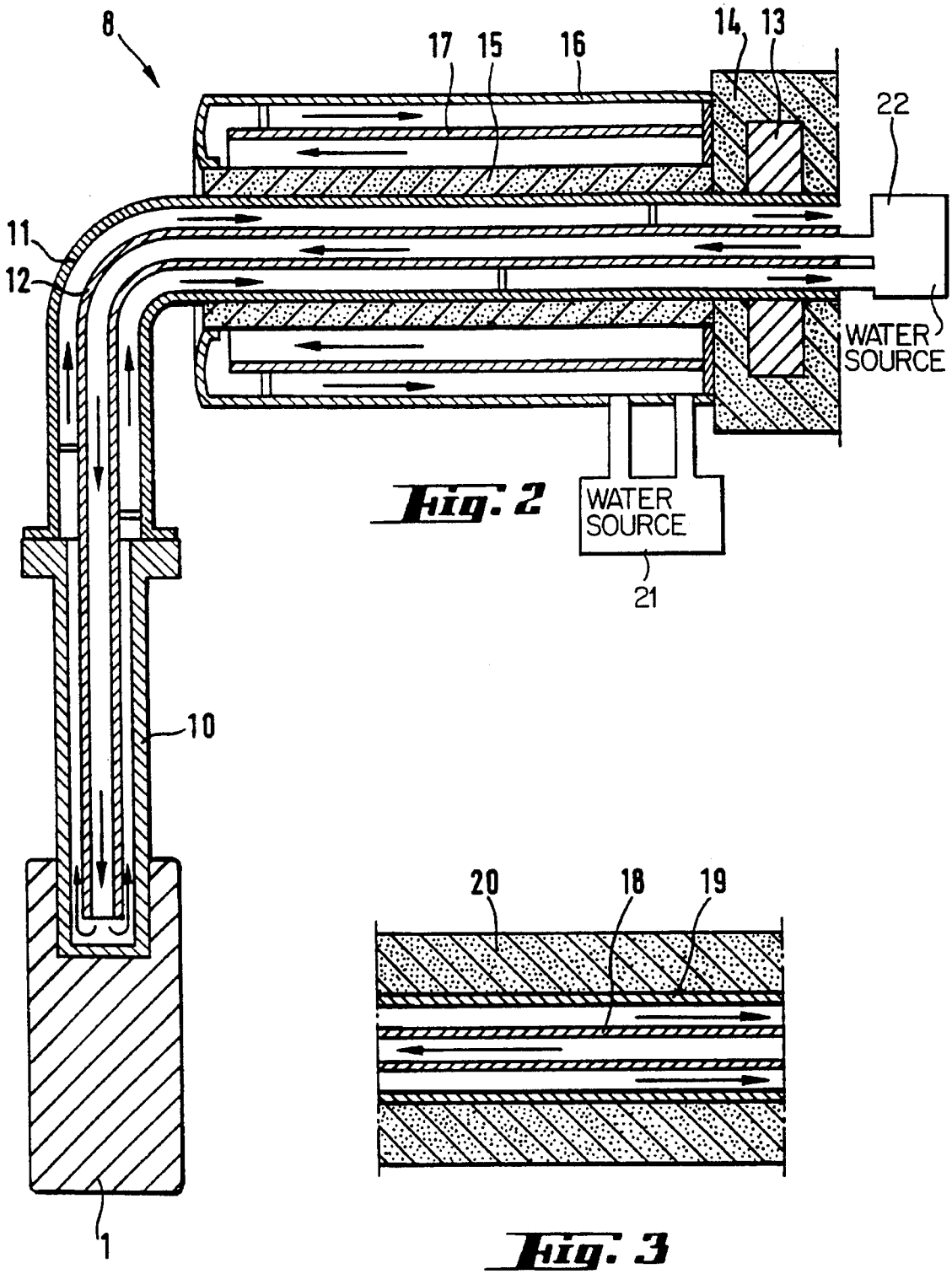
FIG. 2 is an embodiment of an electrode and its support according to the invention.
FIG. 3 is a schematic representation of part of a support according to another embodiment of the invention.

In FIG. 2, the electrode 1 and its support 8 are represented in greater detail, and show the advantages of the invention.

The electrode 1, which is habitually made of molybdenum, is attached by means of a current-conductor component 10, to the tube 11 which constitutes the electric current-conductor cooling device. The component 10 is an extension which is attached to the tube 11 by being screwed. The electrode 1 is attached to the other end of this extension 10. An arrangement of this type enables the extension 10 / electrode 1 assembly to be dismantled easily, since the point of screwing is never dipped in the melting bath. In fact, if the tube 11 were longer, and were dipped directly in the bath, the electrode 1 could be attached directly to the latter, for example by being screwed. On the other hand, it would become much more difficult to dismantle the electrode, since the point of attachment would have been dipped in the melting bath. According to the present arrangement, the change is very easy but nevertheless requires the extension 10 to be replaced at the same time as the electrode 1. This extension 10 can be surrounded at least partially by a refractory material which is sufficiently thick to prevent direct contact with the raw materials or the molten bath.

In addition, the extension 10 permits passage of the cooling fluid to the electrode, such that the latter is cooled.

Attachment by screwing is advantageous since it permits rapid replacement. Electrodes may need to be replaced frequently, not only when they are worn, but also so that the electrodes, and in particular their length, can be modified, such as to modify the level of immersion, and thus the energy conveyed to the furnace. The tube 11 can consist of steel, such that it has good properties of rigidity and conduction.

Within this tube 11 there is disposed a second tube 12, which for example is concentric. This second tube 12 is for example attached at various points to the inner surface of the tube 11. The association of these two tubes 11 and 12 permits circulation of water and thus constitutes a water-jacket type cooling device. Water is provided by water source 22. Since the cooling system is designed to cool the electrode 1, the tube 12 passes through the extension 10.

At the other end of the tube 11, there is attached a supply collar 13, which for example is made of copper, and is disposed inside the insulating framework 14. This collar 13 enables the tube 11 to be set to the required voltage, the tube being the electric conductor which supplies the electrode 1 with the same voltage.

Around the tube 11 there is disposed an electric insulating material 15 which advantageously consists of a refractory material of the type of electric insulation marketed under the reference MURATHERM 500 M. The material 15 is in the form of one or a plurality of sleeves which envelop and are supported on part of the outer surface of the tube 11. This electric insulating material thus permits access to the electrode support, without any risk of electrocution to the operators who need to approach the melting bath. The material 15 is itself surrounded by a concentric envelope 16 in which there circulates a cooling fluid such as water. Water is provided by water source 21. This envelope 16 of the water-jacket type comprises an inner sleeve 17 which allows the water to circulate.

This second cooling device firstly enables overheating of the insulating material to be avoided, even if the latter is selected such as to be able to resist quite high temperatures, and is already partially cooled by the first cooling system.

Secondly, it enables an outer surface of the electrode support 8 to be obtained which is maintained relatively cold, and can be handled or at least approached by an operator, even when the furnace is in a waiting period, and the support 8 is heated substantially by radiation from the melting bath, when the layer 9 of raw material is absent.

The various aforementioned components 11, 12, 15, 16, 17 constitute tubes, which for example are concentric and are disposed one around another.

In the case in FIG. 3, a cooling device of the current-conductor water-jacket type consisting of two concentric tubes 18, 19, is surrounded by one or a plurality of sleeves 20 which are made of an electric insulating material and have good properties of thermal insulation and resistance to temperature.

Thermal protection of the surface of the electrode support is obtained firstly by means of the nature of the sleeve 20, and secondly by means of the cooling device which enables this sleeve 20 to be cooled.

Electrical protection is provided by the sleeve 20 which envelops the current-conductor tube 19.

The various pipes which permit entry and exit of the cooling water are not shown in the figures.

The water used for cooling is advantageously demineralized water, which enables the same circuits to be used for both cooling systems without any risk of conducting current to the outer cooling system, which moreover is earthed.

The un-numbered arrows indicate the various circuits followed by the cooling fluid.

The electrode together with its support thus described according to the invention, permits firstly use without danger in normal operation, since no accessible device is connected to a voltage supply, and secondly use without any danger of damaging the support when the furnace is in a waiting period.

The device consisting of the electrode and its support according to the invention thus permit maintenance of the various above-described advantages associated with electric melting by means of an electrode immersed from the melting bath. These advantages are for example good thermal output, good quality of the molten material despite modifications of draught, and an increase in the service life of the furnace, since the refractory units are less subject to attack, and the electrodes can be changed easily.

In addition, the device according to the invention eliminates the need for electrodes to be totally immersed during periods of wait, or for the full-time presence of a protection system, thus dispensing with the presence of operators in the vicinity of components which are continually switched on.

We claim:

1. A support for a melting electrode, said support comprising a power lead system for providing a current to said electrode and a cooling device, wherein a surface of said support is provided with thermal protection and said surface is electrically insulated from said power lead system.

2. The support of claim 1, wherein said power lead system is a current-conductor water-jacket cooling system, and said cooling system is surrounded by electric insulation.

3. The support of claim 2, wherein said electric insulation comprises a high temperature resistant insulation.

4. The support of claim 2, wherein said electric insulation is surrounded by a coolant fluid-containing jacketed cooling system.

5. The support of claim 3, wherein said electric insulation is surrounded by a coolant fluid-containing jacketed cooling system.

6. The support of claim 4, wherein the coolant fluid of said fluid-containing jacketed cooling system is conveyed by a circuit other than said current-conductor fluid jacketed cooling system.

7. The support of claim 5, wherein the coolant fluid of said fluid-containing jacketed cooling system is conveyed by a circuit other than said current-conductor fluid jacketed cooling system.

8. The support of claim 4, wherein the coolant fluid of said fluid-containing jacketed cooling system is conveyed by the same circuit which supplies said current-conductor jacketed cooling system.

9. The support of claim 5, wherein the coolant fluid of said fluid-containing jacketed cooling system is conveyed by the same circuit which supplies said current-conductor jacketed cooling system.

10. The support of claim 7, wherein the coolant fluid is water.

11. The support of claim 8, wherein the coolant fluid is water.

* * * * *